US006708406B2

(12) United States Patent
Tomita et al.

(10) Patent No.: US 6,708,406 B2
(45) Date of Patent: Mar. 23, 2004

(54) METHOD OF MANUFACTURING SHOE FOR COMPRESSOR

(75) Inventors: Masanobu Tomita, Kariya (JP); Yasuhiro Miura, Kariya (JP); Kazuhiko Nagao, Nagoya (JP); Tadashi Furukawa, Nagoya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/163,194

(22) Filed: Jun. 5, 2002

(65) Prior Publication Data

US 2002/0189316 A1 Dec. 19, 2002

(30) Foreign Application Priority Data

Jun. 15, 2001 (JP) ..... 2001-181816

(51) Int. Cl.[7] ..... B23P 15/00

(52) U.S. Cl. ..... 29/888.02; 29/888.022; 29/557; 72/356

(58) Field of Search ..... 29/888.02, 557, 29/888.022; 72/356; 148/693

(56) References Cited

U.S. PATENT DOCUMENTS 4,512,175 A * 4/1985 Kaku et al. ..... 72/360
5,076,089 A * 12/1991 Takami ..... 72/356
5,950,480 A 9/1999 Fukushima ..... 72/336
2002/0166611 A1 * 11/2002 Sugiura et al. ..... 148/693
2002/0189316 A1 * 12/2002 Tomita et al. ..... 72/356
2003/0088979 A1 * 5/2003 Tomita et al. ..... 29/888.02

FOREIGN PATENT DOCUMENTS

EP 56136249 10/1981
JP A-11-132143 5/1999

OTHER PUBLICATIONS

EP 02 01 2682 Search Report dated Oct. 6, 2003.

* cited by examiner

*Primary Examiner*—I Cuda Rosenbaum
(74) *Attorney, Agent, or Firm*—Woodcock Washburn LLP

(57) ABSTRACT

Compressor shoe is manufactured by cutting a wire into cut pieces each having a volume approximately equivalent to that of a desired shoe. The cut piece is sequentially forged with forging dies having three cavities. The cut piece is first forged to a cylindrical shape with a small rounded portion, then to a rugby ball shape, and then to a shape corresponding to a shoe shape. A finishing step, including heat treatment, is then carried out to obtain a compressor shoe.

3 Claims, 6 Drawing Sheets

METHOD OF MANUFACTURING SHOE FOR COMPRESSOR

BACKGROUND OF THE INVENTION

1. Field of the Invention

The present invention relates to a method of manufacturing a shoe for a compressor.

2. Description of the Related Art

A compressor, that compresses a refrigerant gas, is built into a refrigerating circuit that is used as a vehicle air conditioner or the like. For example, a known variable-displacement-type swash-plate compressor has a plurality of cylinder bores 91*a* formed in a cylinder block 91, as shown in FIG. 9. A piston 92 is accommodated in each cylinder bore 91*a* so as to be able to carry out a reciprocating motion. Further, a swash plate 93 is supported by a drive shaft, not shown, such that the swash plate 93 is rotatable synchronously with the drive shaft and is tiltable with respect to the drive shaft. A pair of shoes 94 are provided, on each side of the swash plate 93, between the swash plate 93 and each piston 92. As shown in FIG. 10, the upper surface of each shoe 94 forms a part of a spherical surface as a spherical surface portion 94*a*, and the lower surface of the shoe 94 forms approximately a plane surface as a plane surface portion 94*b*. A cylindrical portion 94*c* is formed in the middle between the upper portion and the lower portion via a round portion R.

In the compressor having the above structure, the swash plate 93 rotates synchronously with the drive shaft and makes an inclined movement with respect to the drive shaft, and a rotary motion of the swash plate 93 is converted into a linear reciprocating motion of the piston 92 in the cylinder bore 91*a*, via the shoes 94, based on the rotation of the drive shaft, as shown in FIG. 9. Suction, compression, and discharging of a refrigerant gas are carried out at the head end of the piston 92, based on these motions. During this period, the spherical surface portion 94*a* of each shoe 94 slides on the surface of a spherical surface seat 92*a* of the piston 92, and the plane surface portion 94*b* of the shoe slides on the surface of the swash plate 93. Therefore, the shoe 94 is required to have high size precision and small surface roughness in order to allow a smooth sliding action.

Conventionally, the shoe 94 has been manufactured according to the following process which includes a cutting step and a shoe forming step.

Cutting Step

As shown in FIG. 11, a wire 70 comprising SUJ2 (JIS Japanese Industry Standard G4805), a high carbon chrome bearing steel, is provided. This wire 70 is cut into pieces to obtain cut pieces 71 in a cutting step S90.

Shoe Forming Step

The shoe forming step S91 is then carried out. In a forging step S91*a*, each cut piece 71 is forged with a forging die 95, that has a spherical cavity 95*c* comprising a lower die 95*a* and an upper die 95*b*, to form a sphere as shown in FIG. 12. As a result, an approximately spherical steel sphere 72 having a slight flash 72*a* is obtained, as shown in FIG. 13.

Then, in a flash removing (deburring) step S91*b* in FIG. 11, a flash (a burr) is removed by sandwiching the steel sphere 72 between two rotary casting boards, not shown, and by rotating the casting boards, thereby to obtain a flashless ball 73.

Next, in a heat treating step S91*c*, hardening and tempering are carried out to obtain a heat-treated ball 74.

In a grinding step S91*d*, the heat-treated ball 74 is ground with casting boards similar to those explained above and is ground with a grindstone, thereby to obtain a ground ball 75. The hard ground ball 75 obtained in this way can also be used as a ball of a rolling bearing.

Further, the ground ball 75 is annealed in an annealing step S91*e*, thereby to obtain an annealed ball 76 that has a slightly lower hardness than that of the ground ball 75 and that has no internal distortion.

Then, in a rotary grinding step S91*f*, the annealed balls 76 and a slurry are put into a rotary grinder, not shown, and are rotated together. As a result, the annealed balls 76 are brought into contact with each other, and are mutually ground. Gloss is added to these balls, and stains adhered to the surfaces of these balls are removed.

Further, in a washing step S91*g*, an ultrasonic cleaning is carried out to remove slight stains adhered to the surfaces. A visual inspection step S91*h* is carried out, and an anticorrosive is then coated onto the balls in an anticorrosive processing step S91*i*. As a result, a raw ball 77 having a true spherical shape is obtained.

In a pressing step S91*j*, the raw ball 77 is pressed to obtain a material 78 formed in a shoe shape.

Further, in a heat treating step S91*k*, hardening and tempering are carried out. Then, the shoe-shaped material is ground, to obtain a shoe shape and a surface coarseness within a standard, in a finish grinding step S91*l*. The shoe-shaped material is further cleaned in a washing step S91*m*, and is dried in a drying step S91*n* to finally obtain a shoe 94 for a compressor.

The conventional manufacturing method employs the flash removing step S91*b* and, therefore, the grinding step S91*d* and the rotary grinding step S91*f* are necessary. That is, as the steel sphere 72 is obtained in the forging step S91*a* by using the forging die 95 comprising the lower die 95*a* and the upper die 95*b*, it is difficult to obtain a desired shape, and therefore, the cut piece 71 having a slightly larger volume than that of a desired shoe is obtained so that the flash (burr) 72*a* occurs. As a slight gap is formed between the upper die 95*b* and the lower die 95*a* of the forging die 95, the flash 72*a* occurs in this gap.

According to the above conventional manufacturing method, however, the shoe 94 is manufactured from the raw ball 77, after the raw ball 77 has been manufactured. Therefore, many steps such as the forging step S91*a*, the flash removing process S91*b*, the heat treating step S91*c*, the grinding step S91*d*, the annealing step S91*e*, and the rotary grinding step S91*f* are necessary. In addition, as the raw ball 77 is completed through the above steps, and thereafter, the raw ball 77 is again subjected to the pressing step S91*j* that deforms the raw ball 77 to obtain the material 78 which is in turn subjected to the heat treating step S91*l* and the finish grinding step S91*i*. Therefore, an extremely large number of steps are carried out on the wire 70. Consequently, the process takes a long time, and is expensive.

SUMMARY OF THE INVENTION

The present invention has been made in the light of the above problems. It is, therefore, an object of the present invention to provide a method of manufacturing a shoe for a compressor that can shorten the manufacturing time and can reduce the manufacturing cost.

In order to achieve the above object, according to the present invention, there is provided a method of manufacturing a shoe for a compressor comprising the steps of cutting a steel wire to obtain a cut piece, and forming a shoe for a compressor from the cut piece, wherein, in the cutting step, the wire is cut so that the cut piece has a volume approximately equivalent to that of a desired shoe, wherein the forming step comprises the steps of sequentially forging the cut piece with forging dies having three or more cavities to obtain a shoe-shaped material, and finishing said material by at least a heat treatment to obtain the shoe.

In this method, after the cut piece is obtained by cutting the wire into the cut piece having a volume approximately equivalent to that of a desired shoe in the cutting step, the shoe is manufactured in the forming step comprising the forging step and the finishing step. Therefore, a heat treating step, a grinding step and an annealing step which are carried out in a conventional manufacturing method to obtain a raw ball can be omitted.

Further, according to this method, the cut piece is cut in the cutting step so that it has a volume approximately equivalent to that of a desired shoe, and the cut piece is sequentially forged with forging dies having three or more cavities in the forging step to obtain the shoe. Therefore, there occurs small distortion in the cut piece in each forging step, and the obtained material has a highly precise dimension and there is smaller occurrence of a flash. Therefore, the conventional flash removing process becomes unnecessary. The material is then heat-treated to obtain the shoe in the finishing step.

Therefore, according to this manufacturing method, it is possible to omit many steps, compared with the conventional manufacturing method, and it is possible to shorten the manufacturing time, with a reduction in a cost for equipment and goods. It is thus possible to reduce the manufacturing cost. As the number of processes is decreased, it is also possible to prevent wastage of energy since the number of manufacturing steps is reduced.

BRIEF DESCRIPTION OF THE DRAWINGS

The present invention may be more fully understood from the description of the preferred embodiments of the invention, as set forth below, together with the accompanying drawings, in which.

DESCRIPTION OF THE PREFERRED EMBODIMENTS

An embodiment of the present invention and a comparative example will be explained below with reference to the drawings.

Cutting Step

Figure 1:
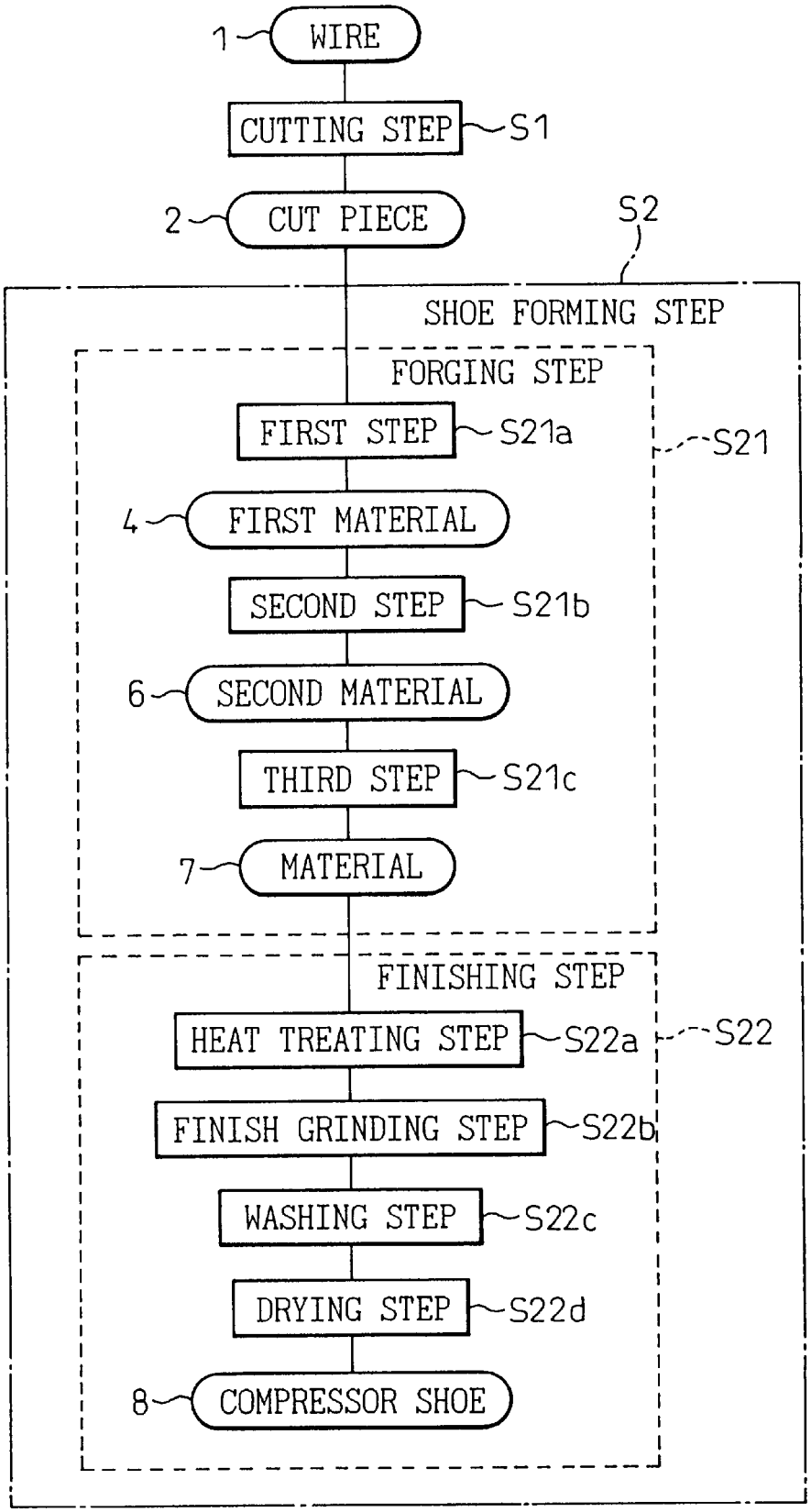
FIG. 1 is a process diagram according to the embodiment of the present invention.
Figure 2:
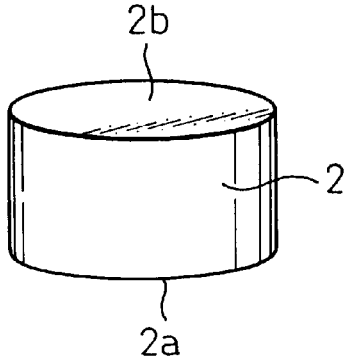
FIG. 2 is a perspective view of a cut piece.
Figure 10:
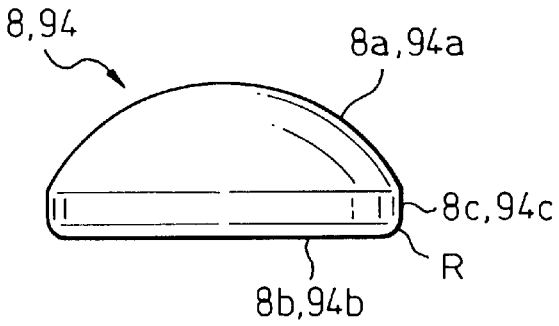
FIG. 10 is a side view of the shoe according to the embodiment and the comparative example.

In the method of manufacturing a shoe for a compressor in the embodiment of the present invention, a wire 1 comprising an SUJ2 (JIS G4805), a high carbon chrome bearing steel, is provided, as shown in FIG. 1. A cutting step S1 is carried out to cut the wire 1 into cut pieces each having a volume approximately equivalent to that of a desired shoe 8 (FIG. 10). In this way, a cylindrical cut piece 2 having one end surface 2*a* and the other end surface 2*b*, is obtained, as shown in FIG. 2.

Shoe Forming Step

A shoe forming step S2, which includes the following steps, is then carried out as shown in FIG. 1.

(1) Forging Step

Figure 3:
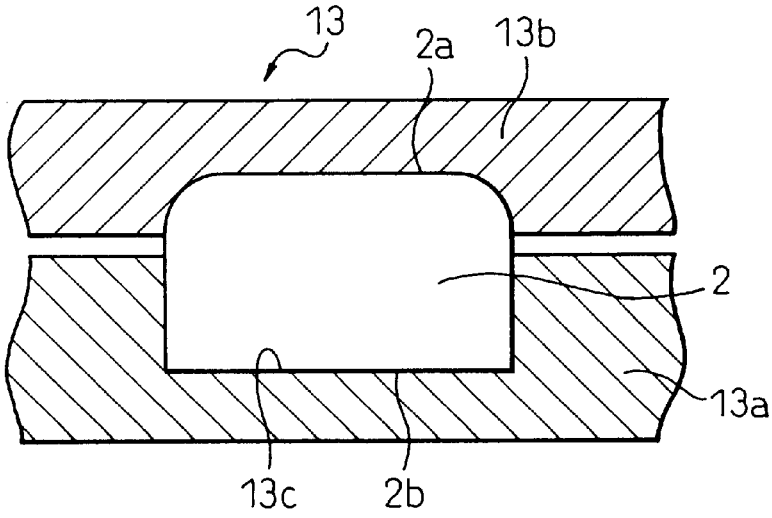
FIG. 3 is a partial cross sectional view of a first forging die in a state that a cut piece is inserted into this die.
Figure 5:
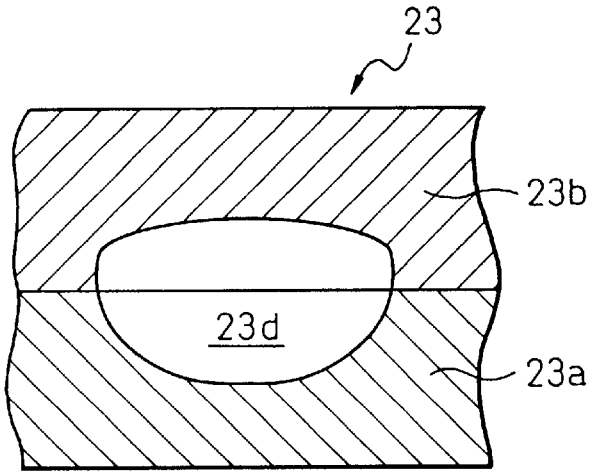
FIG. 5 is a partial cross sectional view of a second forging die.
Figure 7:
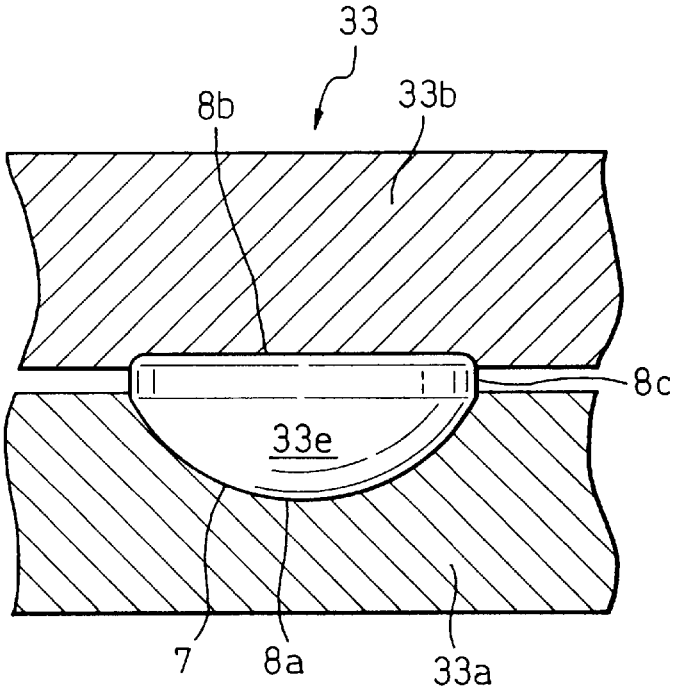
FIG. 7 is a partial cross sectional view of a third forging die.

The forging step S21 is carried out. Three forging dies 13, 23, and 33, as shown in FIG. 3, FIG. 5, and FIG. 7 respectively are prepared, for this purpose. These forging dies 13, 23, and 33 have lower dies 13*a*, 23*a*, and 33*a*, and upper dies 13*b*, 23*b*, and 33*b* that can move relative to the lower dies 13*a*, 23*a*, and 33*a*, respectively. The lower dies 13*a*, 23*a*, and 33*a*, and the upper dies 13*b*, 23*b*, and 33*b* have cavities 13*c*, 23*d*, and 33*e*, respectively.

First, the forging die 13 shown in FIG. 3, that is used in a first forging step S21*a*, shown in FIG. 1, forms the cavity 13*c*, with the lower die 13*a* defining a flat end surface and a peripheral surface, and the upper die 13*b* defining a flat end surface and peripheral surface with a rounded portion therebetween. The flat surface, the rounded portion and the peripheral surface of the upper die 13*b* are smoothly connected to the peripheral surface of the lower die 13, by a curved line in cross section. When the cut piece 2 is forged within this cavity 13*c*, one end surface 2*a* and the peripheral surface of the cut piece 2 continue in a curved surface, and one end surface 2*a* of this cut piece 2 is rounded as a round portion R. In this case, the role of the upper die 13*b* is to form a curve on one end surface 2*a* of the cut surface 2. Therefore, it is not necessary that the upper die 13*b* comes extremely close to the lower die 13*a* to be connected.

Figure 4:
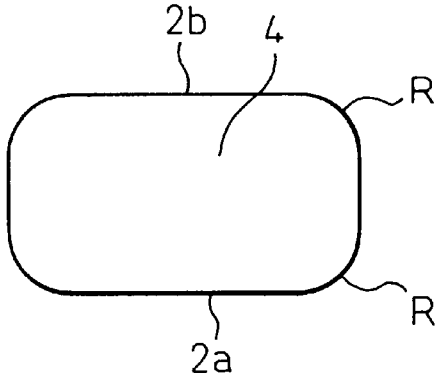
FIG. 4 is a side view of the first material.

Next, the cut piece 2 of which one end surface 2*a* has been rounded as a round portion R is reversed, and the other end surface 2*b* is forged in the same cavity 13*c* of the same forging die 13. In this case, it is also possible to form a curved surface without bringing the upper die 13*b* extremely close to the lower die 13*a*. In this way, the periphery of the other end surface 2*b* is rounded. The first step 21*a* has been completed, and a first material 4, having the first end surface 2*a* and the other end surface 2*b* rounded as round portions R, respectively, is obtained as shown in FIG. 1 and FIG. 4.

Figure 6:
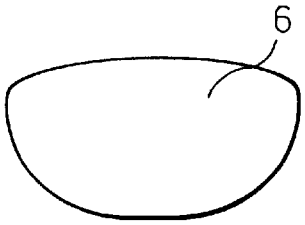
FIG. 6 is a side view of a second material.

In a second step S21*b* shown in FIG. 1, the first material 4 is forged in the forging die 23 having the cavity 23*d* in a shape, like a rugby ball, which is an intermediate shape between the first material 4 and the shoe 8, as shown in FIG. 5. The cavity 23*d* is wholly rounded, compared with the cavity 13*c* of the first die 13. The lower cavity portion is more curved than the upper cavity portion. As a result, a rugby ball shaped second material 6 is obtained as shown in FIG. 6. In this case, it is preferable that the cavity 23*d* has a volume strictly equivalent to or slightly larger than the capacity of the desired shoe 8. The upper die 23*b* and the lower die 23*a* that constitute the forging die 23 cannot be precisely and strictly connected with each other and a slight gap is formed between them. Therefore, it is preferable to avoid factors which may generate a flash (burr) in this gap due to the swelling. No flash occurs on the peripheral surface of the rugby ball shaped second material 6 that has a shape slightly approaching a spherical shape.

Figure 8:
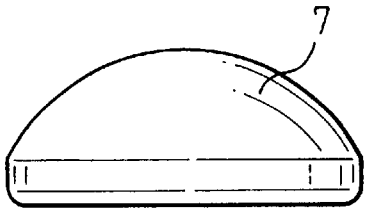
FIG. 8 is a side view of a material.
Figure 9:
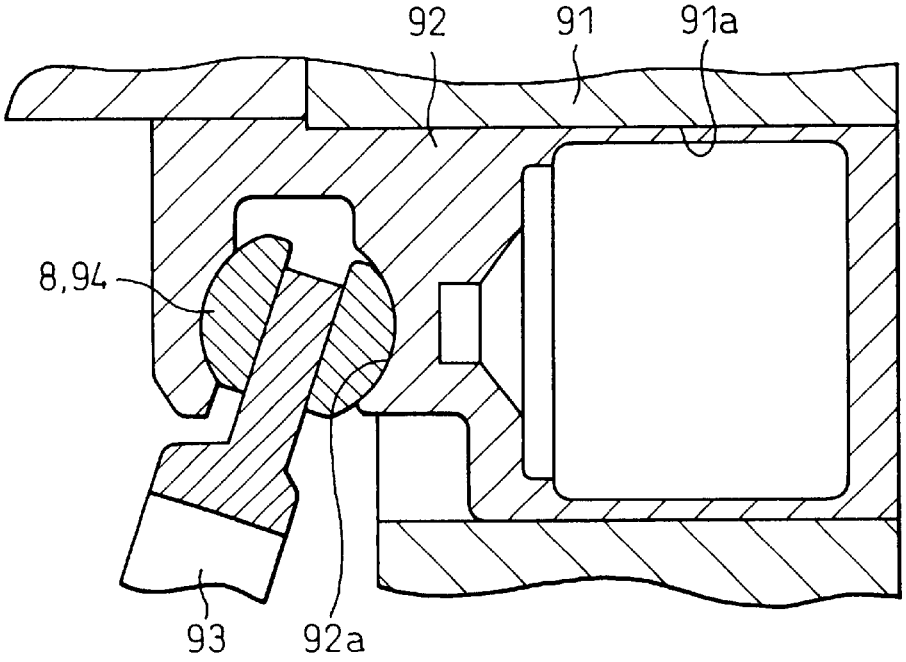
FIG. 9 is a cross sectional view of a main part of a compressor having shoes according to the embodiment and a comparative example.

In a third step S21*c* shown in FIG. 1, the rugby ball shaped second material 6 is forged in the forging die 33 having the cavity 33*e* conforming to the shape of the shoe 8, as shown in FIG. 7. As a result, a material 7 having a shoe shape is obtained, as shown in FIG. 8. The forging step S2 is completed in this way. In this case, it is also preferable that the cavity 33*e* has a volume strictly equivalent to or slightly larger than the capacity of the desired shoe 8. As the second material 6 having the rugby ball shape, which is near the shape of the shoe 8, is changed into the material 7, the quantity of deformation is small. Consequently, factors which may generate flash become smaller. Flash does not occur on the material 7 in the shoe shape, except that an extremely small belt-shaped recess may possibly occur at the central region. However, if the belt-shaped recess occurs, the recess would be located in the cylindrical portion 8*c* of the shoe 8 between the spherical portion 8*a* and the flat portion 8*b*, and when the shoes 8 are arranged in the compressor, the recess is not located in a sliding portion relative to the spherical seat 92*a* of the piston 92 and the swash plate 93, so the recess has no influence.

Finishing Step

A finishing step S22 is then carried out, which includes the following steps.

The shoe-shaped material 7 is hardened and tempered in a heat treating step S22*a*. Then, a finish grinding step S22*b*, a washing step S22*c*, and a drying step S22*d* are carried out. As a result, the shoe 8 for a compressor is obtained.

COMPARATIVE EXAMPLE

Figure 11:
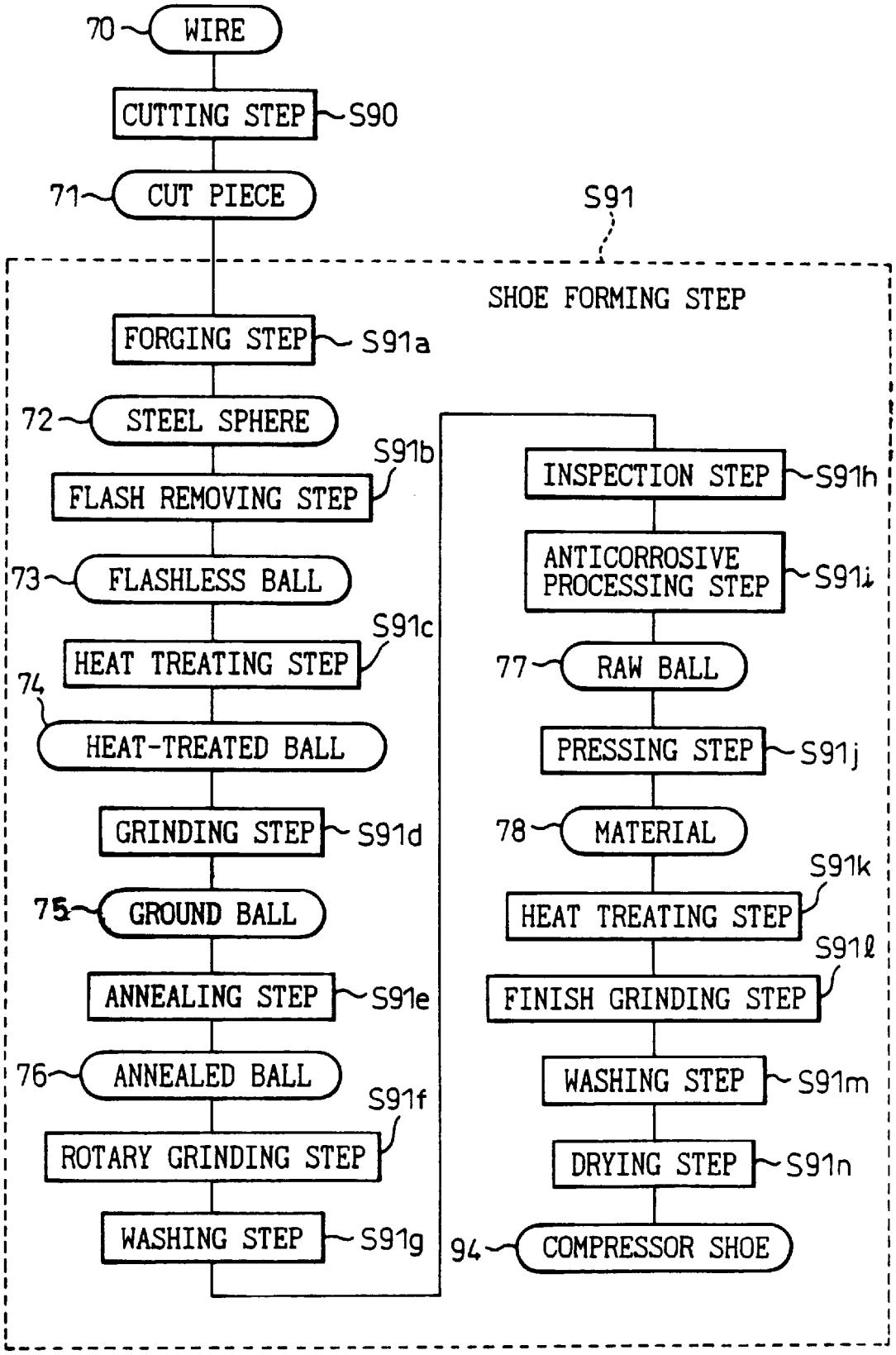
Fig. 11 (Prior Art)
FIG. 11 is a process diagram according to a conventional example.
Figure 12:
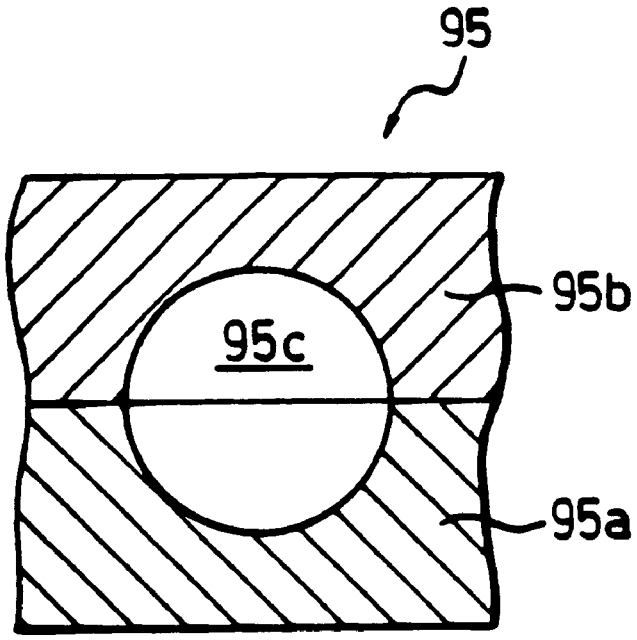
Fig. 12 (Prior Art)
FIG. 12 is a partial cross sectional view of a forging die of the conventional example.
Figure 13:
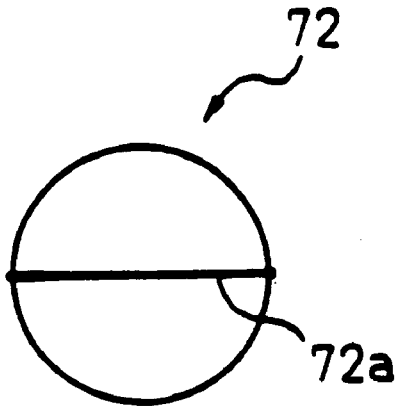
Fig. 13 (Prior Art)
FIG. 13 is a side view of the steel sphere of the conventional example.

In a manufacturing method of the comparative example, a shoe 94 for a compressor is obtained by employing the conventional method of manufacturing a shoe for a compressor shown in FIG. 11.

The manufacturing method of the embodiment can be compared with that of the comparative example, and the shoes 8 and 94 obtained from these manufacturing methods can be compared with each other as follows.

In the manufacturing method of the embodiment, the material 7 in the shoe shape is obtained directly from the cut piece 2, by forging the cut piece 2 in the forging step S21. As a result, the heat treating step S91*c*, the grinding step S91*d*, the annealing step S91*e*, the rotary grinding step S91*f*, the washing step S91*g* and the inspecting steps 91*h* of the comparative manufacturing method to obtain the raw ball 77 can be omitted.

In the inventive manufacturing method, the wire 1 is cut into cut pieces each having a volume approximately equivalent to that of the desired shoe 8, in the cutting step S1. Also, in the inventive manufacturing method, there are used the forging dies 13, 23, and 33 having three cavities 13*c*, 23*d*, and 33*e*, respectively, to form the material 7 in the shoe shape in the forging step S21 at the three stages, and the deformation in each forging stage is small. As result, the material 7 formed in the forging step has more precise dimensions and a flash seldom occurs. Therefore, the flash removing (deburring) step S91*b*, which is conventionally carried out, can be also omitted.

Therefore, according to the manufacturing method of the embodiment, it is possible to reduce the manufacturing time, to reduce the cost for equipment and goods, and to thereby reduce the manufacturing cost. Also, as the number of steps is decreased, it is also possible to prevent wastage of energy.

In the embodiment, the forging step S21 is carried out by the three stages, i.e., using the forging dies 13, 23, and 33 having the three cavities 13*c*, 23*d*, and 33*e*, respectively. However, it is also possible to add a further forging die having a separate cavity, between the second step S21*b* of obtaining the rugby ball shaped second material 6 and the third step S21*c* of obtaining the material 7 in the shoe shape. Based on this, it is possible to form the rugby ball shaped material 6 into a material in a shape closer to the shoe shape, so that it becomes possible to further minimize the quantity of deformation when the rugby ball shaped material is forged.

While the invention has been described by reference to a specific embodiment chosen for the purpose of illustration, it will be apparent that numerous other modifications could be made thereto, by those skilled in the art, without departing from the basic concept and scope of the invention.

What is claimed is:

1. A method of manufacturing a shoe for a compressor, comprising the steps of:

cutting a steel wire to obtain a cut piece; and forming a shoe for a compressor from the cut piece;

wherein in the cutting step, the wire is cut so that the cut piece has a volume approximately equivalent to that of a desired shoe;

wherein said shoe forming step comprises the steps of:

sequentially forging the cut piece with forging dies having three or more cavities to obtain a shoe-shaped material directly from the cut piece without forming a steel sphere; and finishing said material by at least a heat treatment to obtain the shoe.

2. The method according to claim 1, wherein said three or more cavities at least comprises a first cavity having a generally cylindrical shape with a rounded end portion, a second cavity having an intermediate shape between the shape of the first cavity and the shape of the shoe, and a third cavity having a generally flat portion and a generally spherical portion conforming to the shape of the shoe.

3. The method according to claim 1, wherein said finishing step comprises the steps of the heat treating step, a finish grinding step, a washing step, and a drying step.

* * * * *